US009441356B2

(12) United States Patent
Welcel

(10) Patent No.: US 9,441,356 B2
(45) Date of Patent: Sep. 13, 2016

(54) MODULAR BUILDING SYSTEM

(76) Inventor: Bryan Welcel, Vero Beach, FL (US)

( * ) Notice: Subject to any disclaimer, the term of this patent is extended or adjusted under 35 U.S.C. 154(b) by 292 days.

(21) Appl. No.: 13/126,788

(22) PCT Filed: Jan. 22, 2010

(86) PCT No.: PCT/US2010/021691

§ 371 (c)(1),
(2), (4) Date: Jul. 1, 2011

(87) PCT Pub. No.: WO2010/090879

PCT Pub. Date: Aug. 12, 2010

(65) Prior Publication Data

US 2011/0277417 A1 Nov. 17, 2011

Related U.S. Application Data

(60) Provisional application No. 61/149,842, filed on Feb. 4, 2009.

(51) Int. Cl.
*E04B 1/24* (2006.01)

(52) U.S. Cl.
CPC ..... *E04B 1/24* (2013.01); *E04B 2001/2451* (2013.01); *E04B 2001/2457* (2013.01); *E04B 2001/2475* (2013.01)

(58) Field of Classification Search
CPC ..... E04B 2001/2448; E04B 1/2608; E04B 1/348; E04B 1/00; E04B 1/58; E04B 1/80; E04C 2/38
USPC ..... 403/252–255, 264; 52/656.9, 655.1, 52/653.2, 36.4, 282.2, 282.5
See application file for complete search history.

(56) References Cited

U.S. PATENT DOCUMENTS

| | | | | | |
|---|---|---|---|---|---|
| 2,855,255 | A | * | 10/1958 | Sonderstrup | 403/256 |
| 3,574,367 | A | * | 4/1971 | Jankowski | 403/201 |
| 3,885,084 | A | * | 5/1975 | Kaiserswerth et al. | 174/371 |
| 3,966,342 | A | * | 6/1976 | Moriya | 403/256 |
| 4,076,438 | A | * | 2/1978 | Bos | 403/402 |
| 4,549,832 | A | * | 10/1985 | Sterl | 403/264 |
| 4,556,337 | A | * | 12/1985 | Marshall | 403/255 |
| 4,799,819 | A | * | 1/1989 | Swoboda | 403/252 |
| 4,907,388 | A | * | 3/1990 | Siahatgar | 52/481.2 |
| 5,134,826 | A | * | 8/1992 | La Roche et al. | 52/584.1 |
| 5,269,619 | A | * | 12/1993 | Warkus et al. | 403/240 |
| 5,279,091 | A | * | 1/1994 | Williams et al. | 52/489.2 |
| 5,533,640 | A | * | 7/1996 | Jolly | 220/216 |
| 5,657,604 | A | * | 8/1997 | Malott | 52/655.1 |
| 6,481,177 | B1 | * | 11/2002 | Wood | 52/656.9 |

(Continued)

*Primary Examiner* — Brian Glessner
*Assistant Examiner* — Paola Agudelo
(74) *Attorney, Agent, or Firm* — Ingram IP Law, P.A.

(57) ABSTRACT

The present invention relates to components and method for modular building system used as houses, home flat, buildings, offices, gazebos, and pavilion, and to assemble the modular building system fast, easy and simple. Specifically a modular building system of the present invention includes structural frames for post and beam of the building system, lock mechanism for connecting and keeping rigidly said structural frames, corner support for connecting the corner of said structural frames, and structural insulated panel for the purpose wall, roof and floor. The structural frame consists of at least a groove and at least pair of bevel surface. Further the lock mechanism includes a top shell, a bottom shell, a tension screw, at least one pair of reed, at least one pair of support pieces, and at least one pair of fill pieces. And also a method for assembling said modular system is provided.

19 Claims, 7 Drawing Sheets

(56) References Cited

U.S. PATENT DOCUMENTS

| | | | | |
|---|---|---|---|---|
| 7,096,637 | B2 * | 8/2006 | McMillan | 52/653.1 |
| 7,748,194 | B2 * | 7/2010 | Carless | 52/656.2 |
| 8,366,340 | B2 * | 2/2013 | Munakata et al. | 403/255 |
| 8,408,835 | B1 * | 4/2013 | Zhang et al. | 403/255 |
| 8,413,401 | B2 * | 4/2013 | Wang | 52/656.9 |
| 2002/0023391 | A1 * | 2/2002 | Nymark | 52/36.4 |
| 2010/0229496 | A1 * | 9/2010 | Munakata et al. | 52/705 |
| 2011/0296787 | A1 * | 12/2011 | Pryor et al. | 52/655.1 |

* cited by examiner

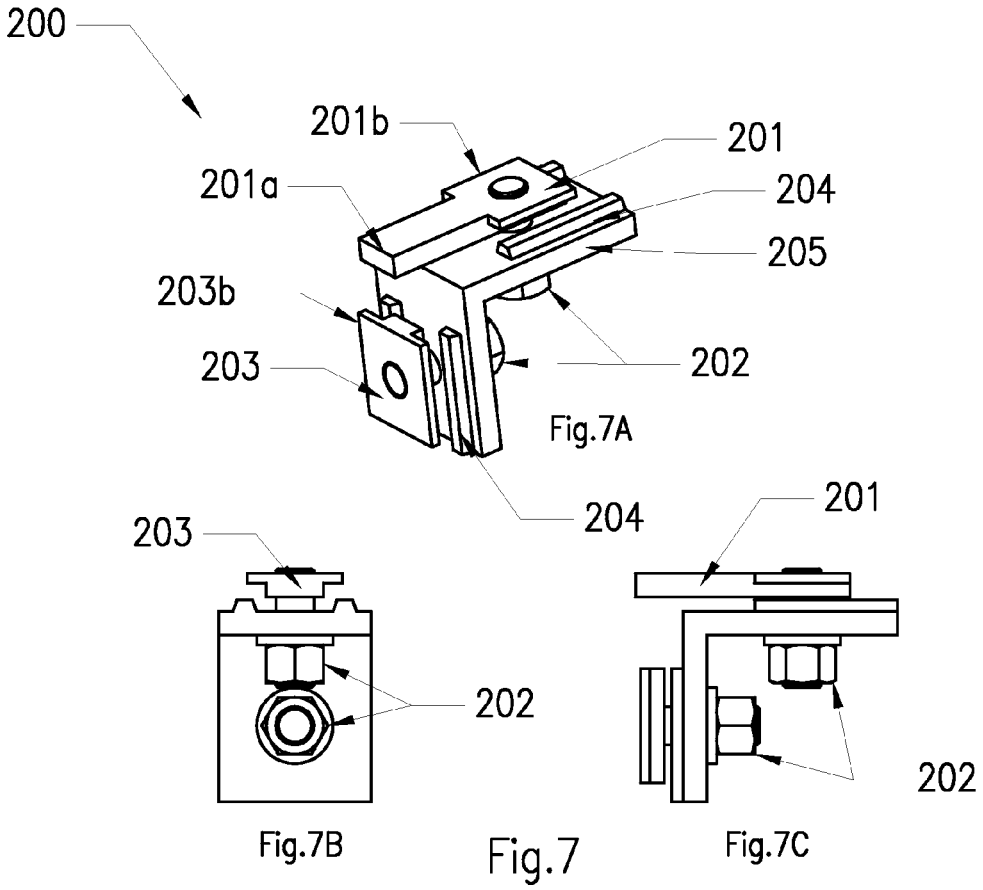
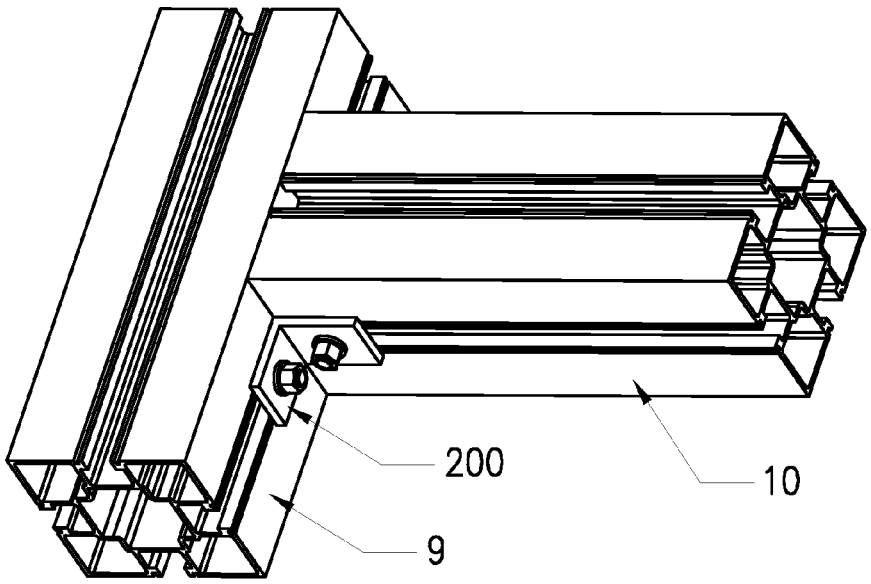
Fig.8

MODULAR BUILDING SYSTEM

This application claims priority to U.S. Provisional Application No. 61/149,842 filed Feb. 4, 2009 and is a 371 application of PCT/US10/21691 filed Jan. 22, 2010, the complete disclosures of which are incorporated herein by reference in their entirety for all purposes.

BACKGROUND

1. Technical Field

The embodiments herein generally relate to a modular building system. Specifically, the embodiments described herein relate to a method and components of assembling modular building system used as houses, home flat, buildings, offices, gazebos, and pavilion such that to assemble the modular building system fast, easy and simple.

2. Description of Related Art

Traditionally, modular building systems are used to construct the building structures in a customized way at a lower cost. Now days, the modular building system is becoming very popular, mainly because of cost advantage and flexibility to transfer the building structure from one place to another place, by dismantling the structure without losing major materials. Such modular building system uses structural frames and various components to assemble the structure of building. The building structure is made of with roof, walls and floor along with the structural frames connected each other to form modular building system in a desired manner. Typically, structural frames are connected and/or joined by using connectors, clamps, locking mechanism [herein after referred as lock mechanism] are known in the prior art. The desirous of the lock mechanism in the modular building system is to connect and/or joint the structural frames each other and also to keep the structural frames together rigidly and strongly without any deformation/displacement of the structural frames.

Attempts have been made to develop various types of lock mechanism and the range of lock mechanism are known in the prior art. However, all the known lock mechanism neither do meet the desirous of the lock mechanism nor do have simple mechanism to handle it nor the configuration of the lock mechanism may able sustain without any wear and tear.

The known modular building systems and method of assembling such systems not only suffers from the drawback of difficulty in handling and assembling various components, but also requires high skill labor and longer duration to form the modular building system. Another disadvantage of such assembling method is the need of cutting and drilling of the frames during assembling of the building systems, which results in wastage in the material.

Therefore there is a need to have a method of assembling modular building system and components that improves the standard way of building a house by making assembly of a building system fast, easy and simple, and allows to precut, predrill, and ship the building system to assemble readily and also allows to built it in days with limited skilled labor and without almost any wasted materials and allows to use of highly recyclable non toxic materials and high energy efficiency, and allows to assemble houses, home flat, buildings, offices, gazebos, and pavilion. And also there is a need to have a lock mechanism in the modular building system that enables to keep the frames together stronger and rigid and reinforced and also over comes the drawback of known lock mechanism.

SUMMARY

In view of the foregoing, an embodiment herein provides components and method for modular building system used as houses, home flat, buildings, offices, gazebos, and pavilion, and to assemble the modular building system fast, easy and simple. Specifically a modular building system of the present invention includes plurality of structural frame for post and beam of the building system, plurality of lock mechanism for connecting and keeping rigidly said structural frames, plurality of corner support for connecting the corner of said structural frames, and plurality of structural insulated panel for the purpose walls, roof and floor. The structural frame consists of at least a groove and at least one pair of bevel surface. Further a lock mechanism of the present invention includes a top shell, a bottom shell, a tension screw, at least one pair of reed, at least one pair of support piece, and at least one pair of fill piece. And also a method for assembling said modular system is provided, wherein said method comprising the step of placing a lock mechanism inside the channel of a beam, inserting pair of reed of the lock mechanism along with the beam inside the groove of a post, tightening the lock mechanism by using a wrench holder to connect the post and the beam of building system, placing corner support at all corners of the post and the beam, and providing structural insulated panels for connecting with the beam and the post.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

FIG. 7 illustrates various view of a corner support according to an embodiment herein;

FIG. 8 illustrates side view of the structural frames with the corner support according to an embodiment herein;

DETAILED DESCRIPTION OF THE PREFERRED EMBODIMENTS

Figure 1:
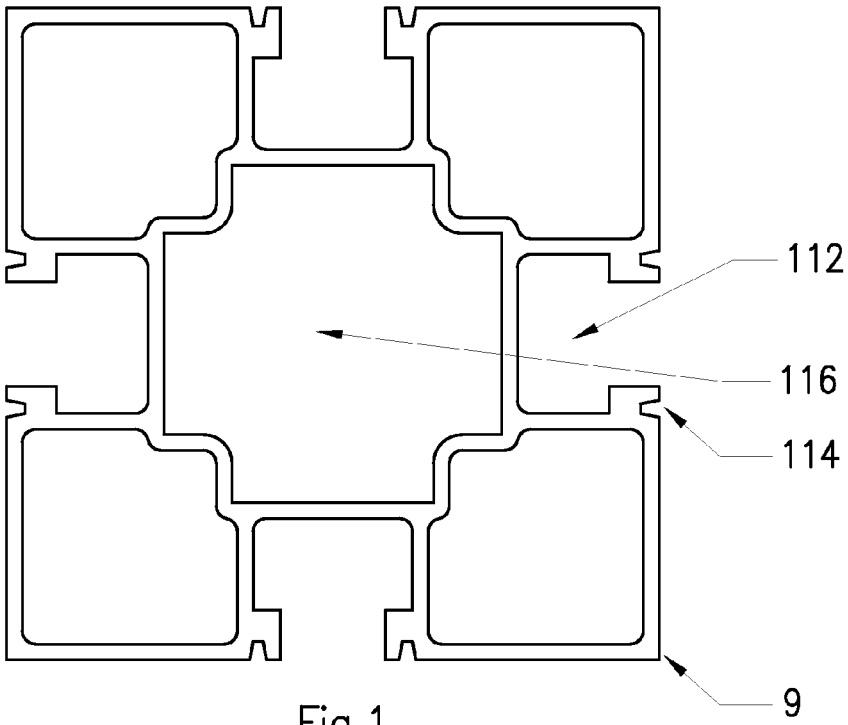
FIG. 1 illustrates top view of a structural frame according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein achieve a modular housing system by providing a method and components thereof. Referring now to the drawings, and more particularly to FIGS. 1 through 10, where similar reference characters denote corresponding features consistently throughout the figures, there are shown preferred embodiments.

FIG. 1 illustrates the top view of a structural frame 9 comprises of at least one groove 112 and at least one pair of bevel surface 114, according to an embodiment. In an embodiment, the structural frame 9 can be configured as post as well beam in the modular building system. The structural frame 9 is kept in vertical while using as a post 9 and the structural frame 9 is kept in horizontal while using as a beam 9. The structural frame 9 is made of aluminum extrusion, according to an embodiment. In another embodiment, the structural frame 9 is made of fiberglass pultrusion. The beam 9 and post 9 (also referred as structural frame 9) is connected together with the help of lock mechanism provided in accordance with an embodiment. The structural frame 9 can be configured with more than one groove 112 and more than one pair of bevel surface 114, which would be described in detail with reference to subsequent FIG. 2A to 2E.

Figure 2:
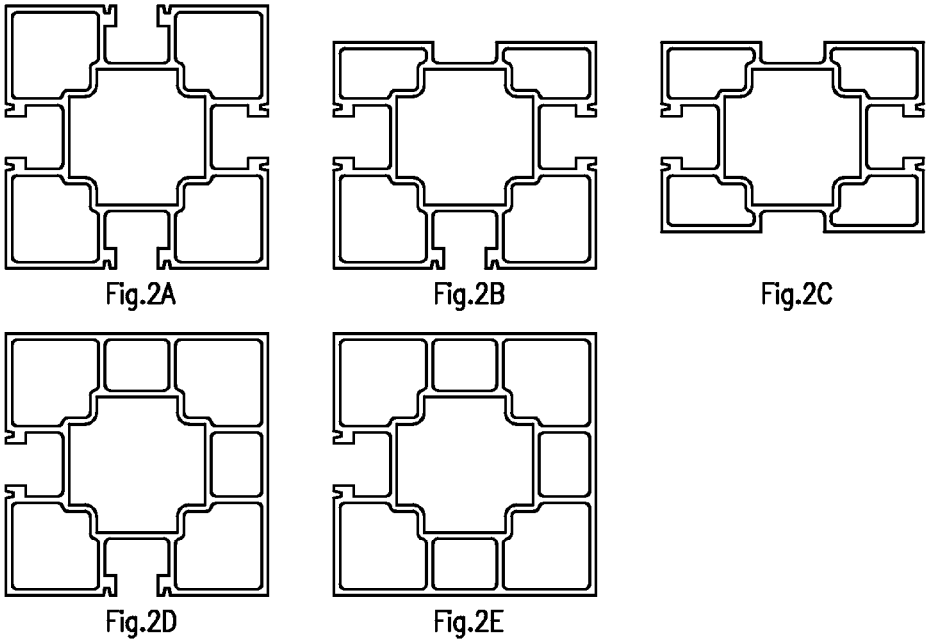
FIG. 2 illustrates various configuration of the structural frames in accordance with embodiment herein.

FIG. 2 illustrates various embodiments of structural frame 9 configuration. FIG. 2A shows the structural frame 9 with four grooves 112 and four pair of bevel surfaces 114. In FIG. 2B illustrates the structural frame 9 with three grooves 112 and three pair of bevel surfaces 114. In FIG. 2C illustrates the structural frame 9 with two grooves 112 and two pair of bevel surfaces 114 placed oppositely. In FIG. 2D illustrates the structural frame 9 with two grooves 112 and two pair of bevel surfaces 114 placed adjacently. In FIG. 2E illustrates the structural frame 9 with only one groove 112 and only one pair of bevel surface 114.

Figure 3:
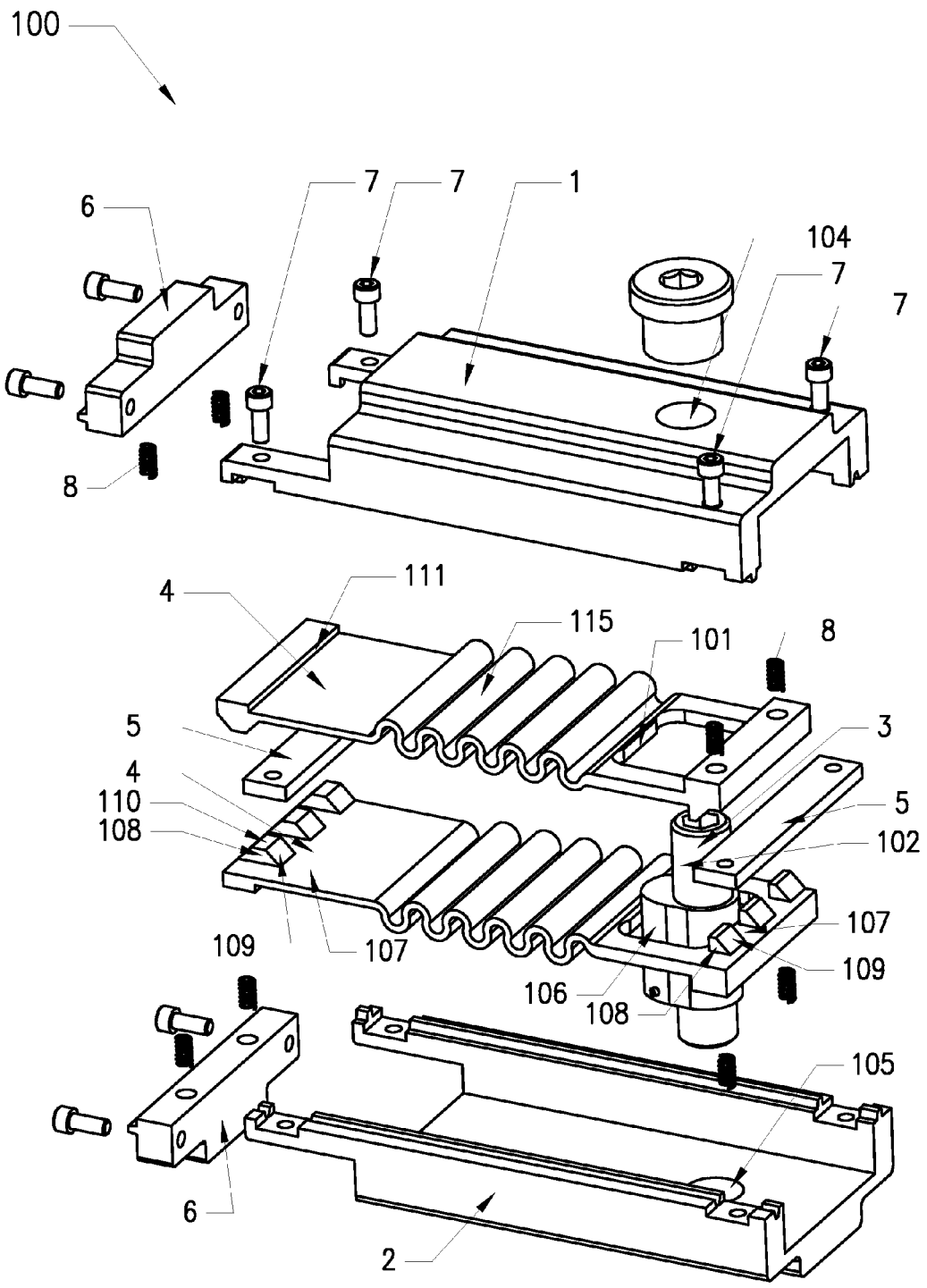
FIG. 3 illustrates three dimension view of a lock mechanism according to an embodiment herein.

FIG. 3 illustrates perspective view of a lock mechanism 100 according to an embodiment. The lock mechanism 100, in an embodiment comprises of a top shell 1, a bottom shell 2, a tension screw 3, a pair of reed 4, a pair support piece 5, a pair of fill piece 6 and a corrugated piece 115. For example, the corrugated piece 115 is made of steel, however it can be made of any suitable material. The support pieces 5 and the fill pieces 6 is placed in between the top shell 1 and the bottom shell 2, and both the shell 1, 2 are connected with the help of screws 7, according to an embodiment. Both the support pieces 5 are placed in between the pair of reed 4, so as to keep the pair of reed 4 rigidly. In an embodiment, edge surface 111 of the reed 4 is made in L shape and bended outward direction, so as to keep the pair of reed 4 in the groove 112 rigidly inside the structural frame 9.

A square hole 101 in the right side of reeds 4, a round hole 104 in the top shell 1 and a round hole 105 in the bottom shell 2 are provided according to an embodiment, to keep the tension screw 3 in between the top shell 1 and top shell 2 and to tighten the tension screw 3. The top part 102 of the tension screw 3 is placed in the round hole 104 of the top reed 4, bottom part 103 of the tension screw 3 is placed in the round hole 104 of the bottom reed 4, and the tension screw 3 is placed into the square hole 101 of the pair of reed 4, according to an embodiment, which helps to keep tension screw 3 inside the top shell 1 and bottom shell 2. The outer surface 106 of the tension screw 3 is tightly held with the pair of reed 4 by means of rigid contact of the outer surface 106 of the tension screw 3 with the square hole 101 of the pair of reed 4.

Figure 4:
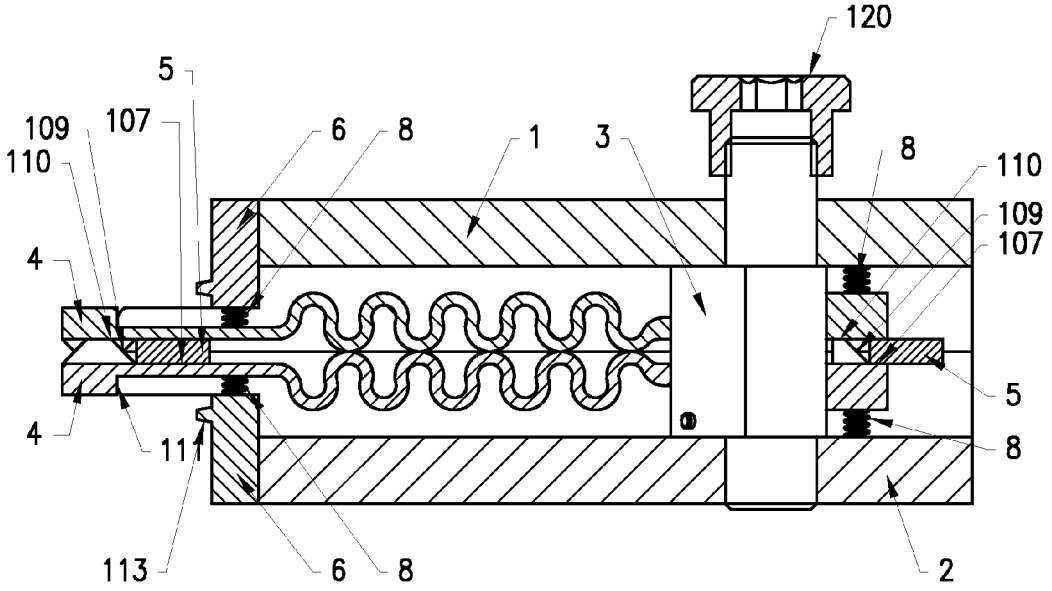
FIG. 4 illustrates cross sectional view of the lock mechanism according to an embodiment herein.

FIG. 4 illustrates the cross sectional view of lock mechanism 100 in accordance with an embodiment. In an embodiment, a pair of lip surface 113 is provided in each of the fill pieces 6. The tension screw 3 inside the lock mechanism 100 is tightened with the help of wrench holder 120. For example, a hexagon wrench (not shown) is used for tightening the tension screw 3 through the wrench holder 120. The tension screw 3 enables the movement of the pair of reed 4 towards inward and outward with respect to the lock mechanism 100, and also to keep the pair of reed 4 closely and separately each other. The pair of reed 4 is kept closely with the help of spring 8 provided at the right corner of the top reed 4 and the bottom reed 4. In one embodiment, the pair of reed is kept separately and inward, while rotating the wrench holder 120 in the clock direc. In an embodiment, the pair of reed 4 is kept closely and outward, while rotating the wrench holder 120 in the anti-clock direction with the help of hexagon wrench. Before inserting the lock mechanism 100 inside the channel 116 of beam 9, the pair of reed 4 is kept closely and outward as shown in FIG. 4.

Now referring to FIG. 3, three convex points 108 are provided at the surface 107 of each reed 4, according to an embodiment. The bevel 109 of the convex points 108 touches with the support pieces 5 and makes to separate the pair of reed 4 each other, while tightening the tension screw 3 with the help of rotating the wrench holder 120 in clockwise direction, according to an embodiment. Further tightening of the tension screw 3 enables the pair of reed 4 to move toward/inward the lock mechanism and to touch the surface 110 of convex points 108 with the surface of support pieces 5, so that the pair of reed 4 does not separate further, and at the same time the pair of reed 4 starts to move inward the lock mechanism 100.

Figure 5:
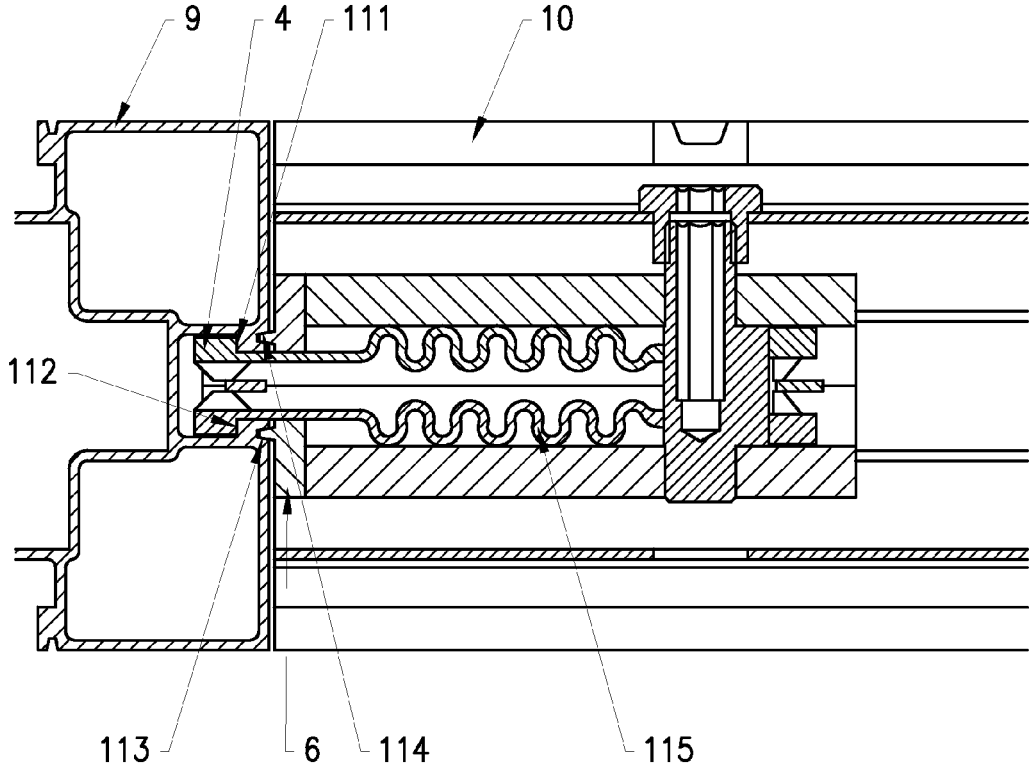
FIG. 5 illustrates perspective view of the lock mechanism placed inside the structural frame according to an embodiment herein.

Now referring to FIG. 5, the lock mechanism 100 is placed inside the channel 116 of the beam 10, according to an embodiment. A hole (not shown) is provided at the channel of the beam 10, so as to insert the wrench holder 120 from the outside of beam with the tension screw 3. According to an embodiment, before inserting the pair of reed 4 of lock mechanism 100 inside the post 9, the wrench holder 120 is turner in anti-clock wise direction to keep the pair of reed 4 closely each other. The pair of reed 4 of the lock mechanism 100 along with the beam 10 is inserted inside the groove 112 of the post 9. After inserting the reeds 4 inside the groove 112 of the post, the tension screw 3 is tightened with the help of wrench holder 120 by rotating the wrench holder 120 in clockwise direction. While tightening the tension screw 3, it separates the pair of reed 4 and makes to move the pair of reed 4 toward/inward the lock mechanism, with the help of corrugated piece 115 provided inside the lock mechanism 100. After slightly tightening the tension screw 3, the edge surface 111 of the reeds 4 touches the outer surface of the groove 112. Further tightening of tension screw 3, allows contacting the fill pieces 6 with the outer surface of the post 9, and also allows contacting the lip surface 113 of fill pieces 6 with the bevel surface 114 of the post 9, by means of inward movement of the reed 4.

While further tightening the tension screw 3, the lock mechanism 100 does not move further and at the same time the outer surface 106 of tension screw 3 makes the square hole 101 of the reed 4 to move in the direction of rotation of wrench holder 120, thus the corrugated piece 115 starts to elongate so that it compresses the edge surface 111 with the outer surface of groove 112, and also firmly connects the lip surface 113 of the fill pieces 6 with the bevel surface 114 of the beam 10.

Figure 6:
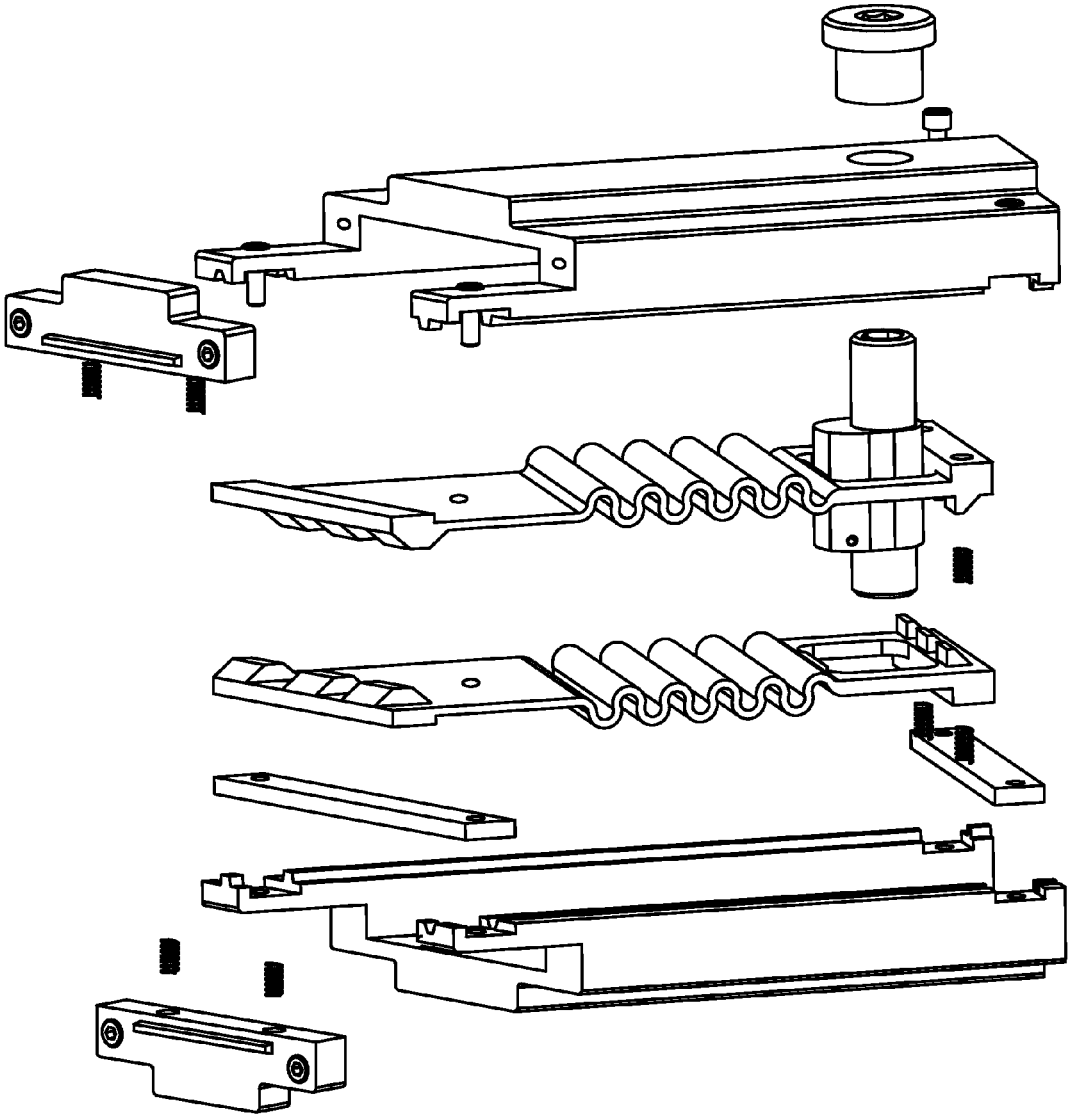
FIG. 6 illustrates cross section view of a varying degree lock mechanism according to an embodiment herein.

The firm and rigid connection between the lip surface 113 and bevel surface 114 expands the positive pressure and thus the post 9 and beam 10 has the anti-slip performance. The corrugated piece 115 provided inside the lock mechanism 100 helps to protect the building from strong external shock or impact. In case, building structure receives strong external shock, the touch surface 111, 112, 113, 114 of the lock mechanism 100 and post 9 generates tremendous extrusion force, thus dent in the post 9 may occur due to the reeds 4 and fill pieces 6 pressing out the post 9. The corrugated piece 115 helps to compensate the depth of the dent, thus it does not reduce the anti-slip performance between the lock mechanism 100 and post 9. The lock mechanism 100 placed inside the channel 116 of beam 10 and the reed 4 placed inside the groove 112 of post 9 connects the beam 10 and post 9 firmly and rigidly by using the lock mechanism 100 as described in the above embodiments. In an embodiment, the lock mechanism 100 can be configured in varying degrees in order to connect the beam 10 and post 9 at the roof. FIG. 6 illustrates varying degree lock mechanism in accordance with one embodiment.

FIG. 7 illustrates the corner support 200 provided in accordance with an embodiment. The corner support 200 comprises of a top part 201, and a pair of bolt 202, side part 203, at least one pair of lip surface 204 and an L shape plate 205, according to an embodiment. The top part 201 can be moved in front and back with the help of bolt 202 provided in the horizontal side of L shape plate 205. The side part 203 can be moved in top and bottom direction with the help of bolt 202 provided at the vertical side of L shape plate 205. A pair of lip surface 204 is provided at the horizontal side of L shape plate 204 to insert the said lip surface 204 in the bevel surface 114 of the beam 10, according to an embodiment. In an embodiment, another pair of lip surface 204 is provided at the vertical side of L shape plate 205 to insert the said lip surface 204 in the bevel surface 114 of the post 9.

Now referring to FIG. 8, the corner support 200 is provided in between corner of the post 9 and beam 10 as shown in the FIG. 7. The top part 201 of the corner support 200 is inserted inside the groove 112 of the beam 10, and the tip portion 201*a* of the top part 201 is inserted inside the groove 112 of the post 9, and also the side part 203 is inserted inside the groove 112 of the post 9, according to an embodiment. The lip surface 204 provided at the top side of L shape plate 205 is placed inside the bevel surface 114 of the beam 10 and the lip surface 204 provided at the vertical side of L shape plate is placed inside the bevel surface 114 of the post 9. After placing the top part 201 and side part 203 in the beam 10 and post 9 respectively, both the part 201, 203 are tightened with the help of tightening the bolts 202 provided in the L shape plate 205. While tightening the bolts 202, the lip surfaces 204 touches the bevel surfaces 114 and the edge surface 201*b* of top part 201 touches the outer surface of groove 112 of the beam 10, and the edge surface 203*b* of side part 203 touches the outer surface of groove 112 of the post 9. After complete tightening of the bolts 202, the lip surfaces 204 connects the bevel surfaces 114 firmly and the edge surface 201*b* of top part 201 connects the outer surface of groove 112 of beam 10 firmly, and the edge surface 203*b* of side part 203*b* connects the outer surface of groove 112 of post 9 firmly, thus the corner support 200 enables to create strong and rigid connection between the post 9 and beam 10, according to embodiments as described above.

Figure 9:
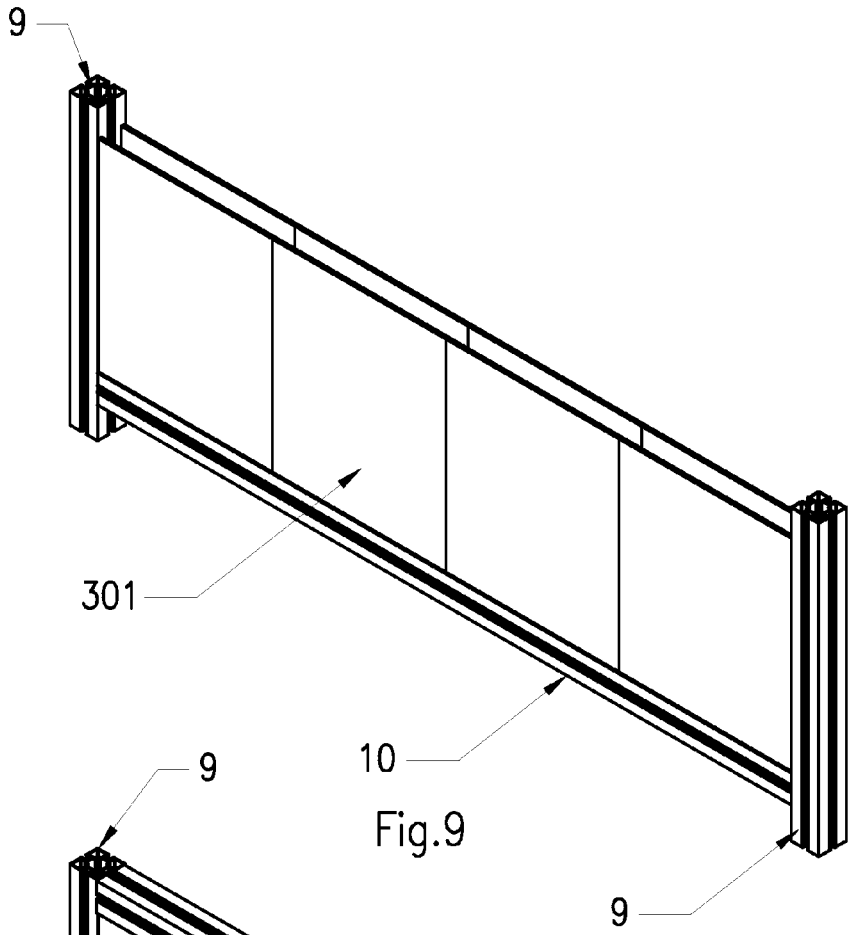
FIG. 9 illustrates side view of a modular building system in accordance with an embodiment herein.
Figure 10:
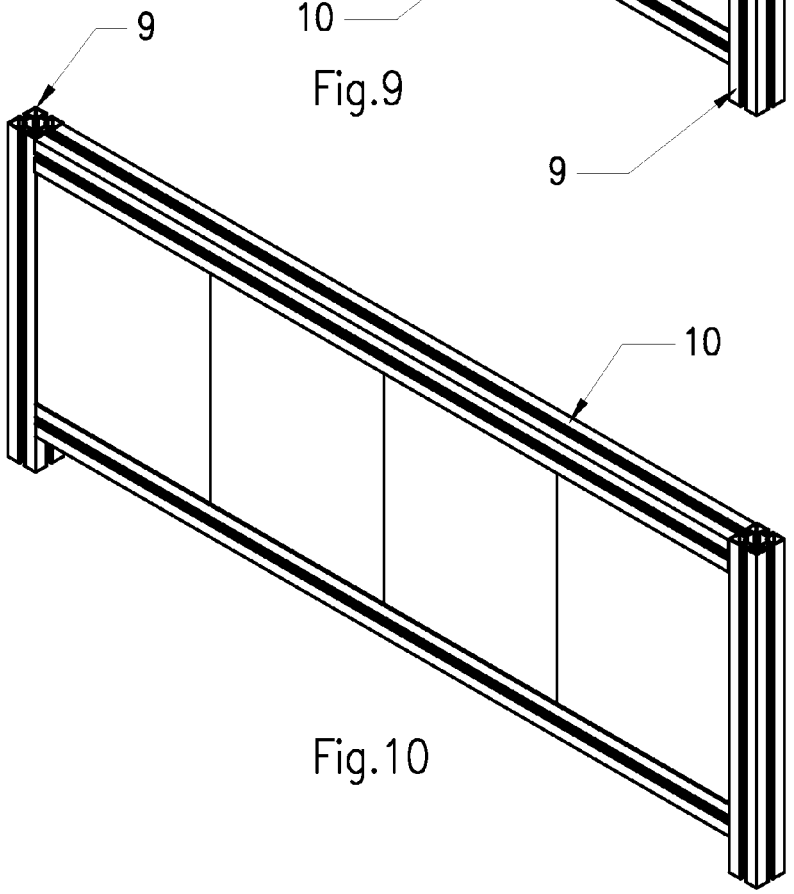
FIG. 10 illustrates side view of the modular building system according to an embodiment herein.

FIG. 9 and FIG. 10 illustrates side view of modular building system, according to an embodiment. In an embodiment, the method for assembling the modular system comprising the step of placing the lock mechanism 100 inside the channel 116 of beam 10, inserting pair of reed 4 of said lock mechanism 100 along with beam 10 inside the groove 112 of post 9, tightening the lock mechanism 100 by using the wrench holder 120 to connect the post 9 and beam 10, placing the corner support 200 at all corners of post 9 and beam 10, and providing structural insulated panels 301 for connecting with the beam 10 and post 9.

According to an embodiment, the post 9 is placed vertically, and the beam 10 is placed horizontally, and the lock mechanism 100 (not shown in FIG. 9) inserted inside the beam 10 for connecting the beam 10 and post 9. Initially the pair of reed 4 of the lock mechanism 100 is kept closely and outward, and then the pair of reed 4 along with the beam 10 is inserted inside the groove 112 of post 9. The wrench holder 120 is turned in clockwise direction to tighten the tension screw 3, so that the reed 4 starts to expand for separating each other and move toward/inward the lock mechanism 100 for connecting the outer surface of groove 112 with the edge surface 111 of the reeds and for connecting the lip surface 113 with the bevel surface 114 of the post 9. After complete tightening of the tension screw 3, the lock mechanism 100 connects the beam 10 and the post 9 rigidly and strongly. The corner support 100 is placed at the corner of the beam 10 and the post 9, and the corner support is tightened with the help of bolts 202, so that it gives further rigidity and firm connectivity between the beam 10 and the post 9.

Further structural insulated panels 301 are provided for the purpose of wall, roof and floor. According to an embodiment, the structural insulated panel 301 are placed in between the post 9 and beam 10, by providing a rim (not shown) inside the structural frames 9 using a 2×6 board bolted (not shown) within the structural frames 9 for a plate to hold the structural insulated panels 301. In another embodiment, a structural frame is provided inside the structural insulated panel 301 to connect the structural insulated panel 301 with the structural frames 9.

Figure 11:
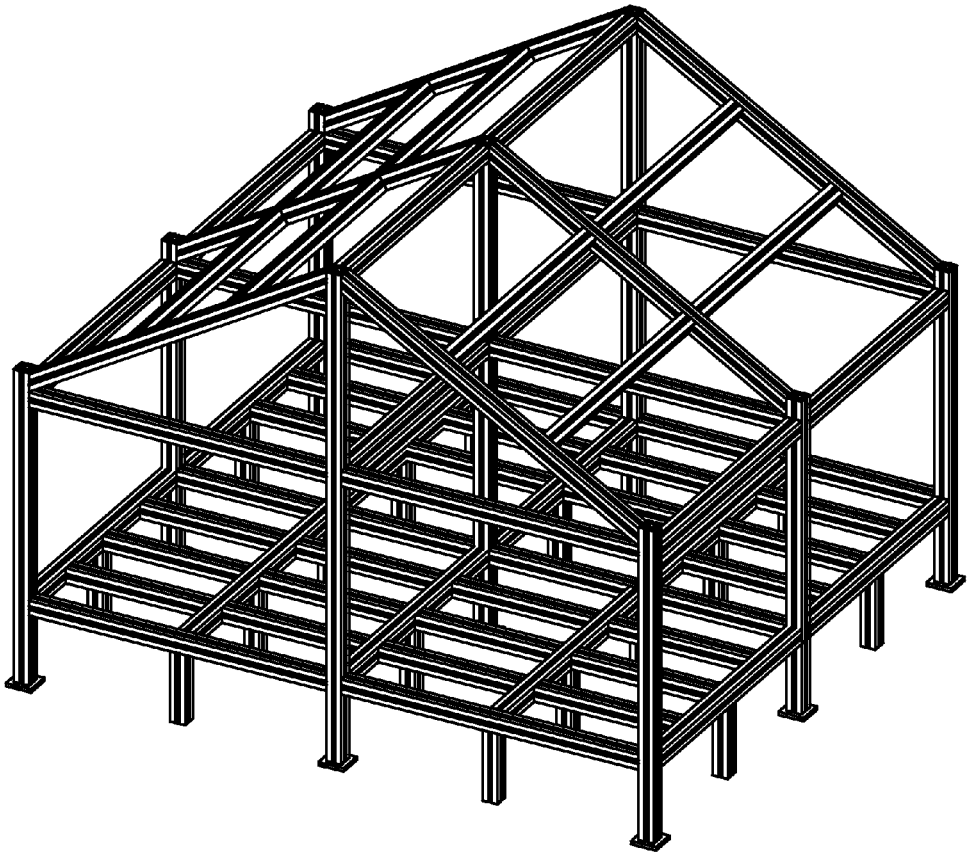
FIG. 11 illustrates a modular building system according to an embodiment herein.

FIG. 11 illustrates a modular building system 400 assembled, according to an embodiment. The modular building system 400, the lock mechanism 100, structural frames 9, corner support 200 provided in accordance with the present invention improves the standard way of building a house by making assembly of a building system 400 fast, easy and simple, and allows to precut, predrill, and ship the building system to assemble readily and also allows to built it in days with limited skilled labor and without almost any wasted materials and allows to use of highly recyclable non toxic materials and high energy efficiency, and allows to assemble houses, home flat, buildings, offices, gazebos, and pavilion. Another advantage of the lock mechanism 100 provided in accordance with present invention enables to keep the frames 9 together stronger and rigid and reinforced and also over comes the drawback of known lock mechanism.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A lock mechanism for a modular building system, said lock mechanism comprising:

a first shell;

a second shell coupled to said first shell to form a cavity therebetween;

a tension screw provided within said cavity; and a pair of reeds provided within said cavity, said pair of reeds being oriented substantially parallel to each other and extending in a direction substantially perpendicular to a longitudinal axis of said tension screw, said pair of reeds including a corrugated piece and beveled protrusions that contact a pair of support pieces positioned between said pair of reeds, said pair of support pieces being adapted to slide along corresponding beveled protrusions to separate said pair of reeds relative to each other.

2. The lock mechanism of claim 1, further comprising:

first springs positioned between said first shell and said corresponding one of said pair of reeds; and second springs positioned between said second shell and said corresponding one of said pair of reeds, said first springs and said second springs being adapted to bias said pair of reeds toward each other.

3. The lock mechanism of claim 1, wherein said lock mechanism is dimensioned to be placed inside a structure of said modular building system, said structure includes at least one of a beam and a post.

4. The lock mechanism of claim 3, wherein end portions of said pair of reeds extend from a first structure and are adapted to be inserted into a groove formed in a second structure, said end portions include edge surfaces that engage surfaces of said groove.

5. The lock mechanism of claim 4, further comprising an aperture formed in said pair of reeds to receive said tension screw therethrough, an outer surface of said tension screw being configured to contact a first side of each aperture to move said pair of reeds in a direction into said cavity, said corrugated pieces of said corresponding pair of reeds being elongated to compress said edge surfaces of said end portions against said surface of said groove.

6. The lock mechanism of claim 5, further comprising fill pieces coupled to corresponding ones of said first shell and said second shell, each of said fill pieces including a lip surface that protrudes therefrom.

7. The lock mechanism of claim 6, wherein said lip surface of said corresponding fill pieces are adapted to be inserted into a bevel surface formed in said second structure when said corrugated pieces of said corresponding pair of reeds are elongated.

8. The lock mechanism of claim 7, wherein said corrugated pieces of said corresponding pair of reeds provides anti-slip forces during an impact force on said modular building system by controlling compression forces of said edge surfaces of said end portions against said surface of said groove and insertion forces of said lip surface of said corresponding fill pieces into said bevel surface.

9. The lock mechanism of claim 1, wherein said pair of reeds includes an aperture that receives said tension screw therethrough, an outer surface of said tension screw being configured to contact a first side of each aperture to move said pair of reeds in a first direction into said cavity and to contact a second side of each aperture to move said pair of reeds in a second direction outward from said cavity.

10. The lock mechanism of claim 1, further comprising fill pieces coupled to corresponding ones of said first shell and said second shell, each of said fill pieces including a lip surface that protrudes therefrom.

11. A lock mechanism for a modular building system, said lock mechanism comprising:

a first shell;

a second shell coupled to said first shell to form a cavity therebetween;

a tension screw provided within said cavity;

a pair of reeds provided within said cavity, said pair of reeds being oriented substantially parallel to each other and extending in a direction substantially perpendicular to a longitudinal axis of said tension screw, said pair of reeds each including an aperture that receives said tension screw therethrough, an outer surface of said tension screw being configured to contact a first side of each aperture to move said pair of reeds in a first direction into said cavity and to contact a second side of each aperture to move said pair of reeds in a second direction outward from said cavity, said pair of reeds including a corrugated piece.

12. The lock mechanism of claim 11, wherein said pair of reeds further comprises beveled protrusions that contact a pair of support pieces positioned between said pair of reeds, said pair of support pieces being adapted to slide along corresponding beveled protrusions to separate said pair of reeds relative to each other.

13. The lock mechanism of claim 11, further comprising:

first springs positioned between said first shell and said corresponding one of said pair of reeds; and second springs positioned between said second shell and said corresponding one of said pair of reeds, said first springs and said second springs being adapted to bias said pair of reeds toward each other.

14. The lock mechanism of claim 11, further comprising fill pieces coupled to corresponding ones of said first shell and said second shell, each of said fill pieces including a lip surface that protrudes therefrom.

15. The lock mechanism of claim 11, wherein said lock mechanism is dimensioned to be placed inside a structure of said modular building system, said structure includes at least one of a beam and a post.

16. The lock mechanism of claim 15, wherein end portions of said pair of reeds extend from a first structure and are adapted to be inserted into a groove formed in a second structure, said end portions include edge surfaces that engage surfaces of said groove.

17. The lock mechanism of claim 15, further comprising fill pieces coupled to corresponding ones of said first shell and said second shell, each of said fill pieces including a lip surface that protrudes therefrom.

18. The lock mechanism of claim 17, wherein said lip surface of said corresponding fill pieces are adapted to be inserted into a bevel surface formed in said second structure when said corrugated pieces of said corresponding pair of reeds are elongated.

19. The lock mechanism of claim 18, wherein said corrugated pieces of said corresponding pair of reeds provides anti-slip forces during an impact force on said modular building system by controlling compression forces of said edge surfaces of said end portions against said surface of said groove and insertion forces of said lip surface of said corresponding fill pieces into said bevel surface.

* * * * *